United States Patent [19]

Raivio

[11] 3,985,380

[45] Oct. 12, 1976

[54] OVERCENTER TYPE LATCH

[75] Inventor: Roy K. Raivio, Berkley, Mich.

[73] Assignee: General Motors Corporation, Detroit, Mich.

[22] Filed: Aug. 8, 1975

[21] Appl. No.: 602,995

[52] U.S. Cl. ..... 292/69; 292/DIG. 49; 292/210; 292/120; 292/DIG. 38

[51] Int. Cl.[2] ..... E05C 5/02

[58] Field of Search ..... 292/DIG. 49, 120, 68, 292/69, 118, 113, 123, 257, 247, 56, DIG. 38

[56] References Cited

UNITED STATES PATENTS

| | | | |
|---|---|---|---|
| 1,637,530 | 8/1927 | Moore | 292/69 |
| 2,867,863 | 1/1959 | Webb et al. | 292/DIG. 49 |
| 3,400,963 | 9/1968 | Jablonski | 292/DIG. 49 |
| 3,466,076 | 9/1969 | Bisbing | 292/DIG. 49 |
| 3,782,765 | 1/1974 | Wallyn | 292/DIG. 38 |

*Primary Examiner*—Richard E. Moore
*Attorney, Agent, or Firm*—Herbert Furman

[57] ABSTRACT

An overcenter type latch for relatively movable members includes a retainer of molded plastic secured to one member and having spaced recesses adjacent one end thereof and a striker adjacent the other end thereof. An operating handle has spaced abutments adjacent one end thereof received within the retainer recesses for pivotal movement of the handle between an overcenter latched position and an unlatched position. An elastomeric link is pivoted to the operating handle and to other member. The link is tensed when the handle is in latched position and extends between the spaced recesses and abutments. A manually operated latch integral with the handle cooperates with the striker to block movement of the handle to unlatched position unless the latch is manually released.

3 Claims, 3 Drawing Figures

OVERCENTER TYPE LATCH

This invention relates generally to overcenter type latches for securing a pair of relatively movable members to each other and more particularly to such a latch including an elastomeric link and a manually operable latch for cooperatively retaining the operating handle in overcenter latched position.

Overcenter type latches are well known. Generally such latches include a handle retainer which is secured to one of a pair of relatively movable members, an operating handle pivoted to the retainer for movement between an overcenter latched position and an unlatched position, and a link pivoted to the handle and to the other of the relatively movable members for retaining the handle in latched position.

The overcenter type latch of this invention is of this general type but includes several features which provide for an improved latch of very simple construction having a minimum number of parts.

One feature is that the handle retainer for securement to one of the relatively movable members is of molded plastic and includes laterally spaced integral recesses adjacent one end thereof and an integral striker adjacent the other end thereof. The recesses receive laterally spaced abutments adjacent one end of a molded plastic handle to pivot the handle to the retainer for movement between latched and unlatched positions. Another feature is that the handle includes an integral manually operable latch adjacent the other end thereof. Such latch includes a web integrally connecting a combined latch member and operator to the under side of the handle. The latch is automatically moved to a blocked position with respect to the retainer striker when the handle is moved to overcenter latched position to block movement of the handle to unlatched position. The latch is moved to an unblocked position when the operator grasps the handle and moves it to unlatched position. The location of the latch on the under side of the handle and between the handle and the retainer provides for easy release only when the handle is manually grasped by the operator. A further feature is that an elastomeric link extends between the handle and the other of the relatively movable members and is located between the spaced abutments and recesses when the handle is in overcenter latched position and the link is tensed. The latch of this invention thus includes only three basic components, the retainer, the handle and the link, and yet provides for both overcenter latching of the relatively movable members and positively engageable latching of the handle to the retainer.

These and other features of the invention will be readily apparent from the following specification and drawings wherein.

Figure 1:
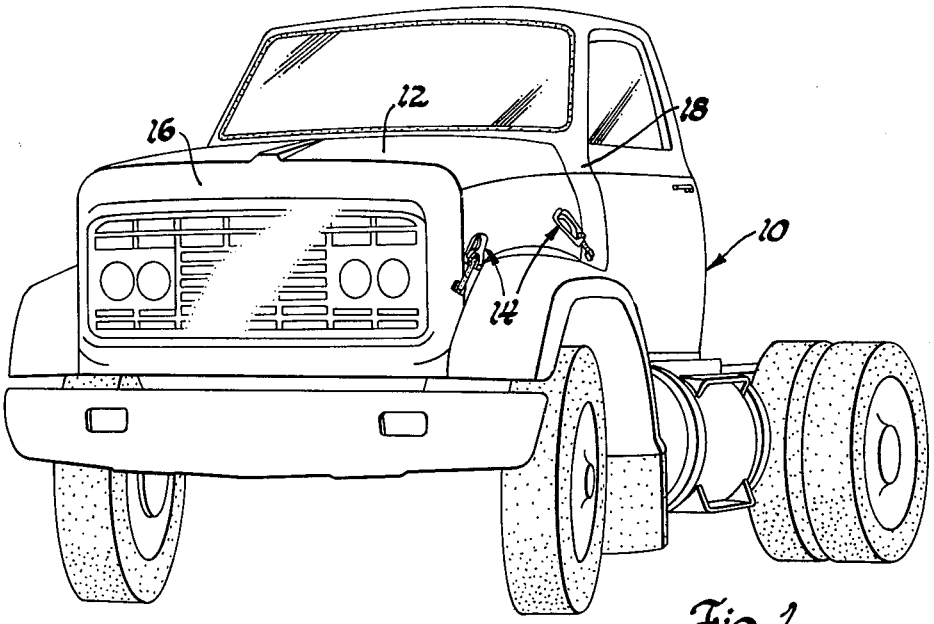
FIG. 1 is a perspective view of a tractor having a hood retained in closed position by overcenter type latches according to this invention.

Referring now to FIG. 1, a conventional tractor 10 includes a hood 12 which is conventionally movable between a closed position as shown and an open position, not shown. The hood 12 is held in closed position by a pair of overcenter type latches 14, according to this invention. The latches 14 connect each side of the hood 12 to the front end structure 16 and the pillar structure 18. Although the latches 14 are shown in combination with a hood of a tractor, and a multiple number of latches are shown, it will be understood that the latch of this invention has other applications and that the number of latches is a matter of design.

Figure 2:
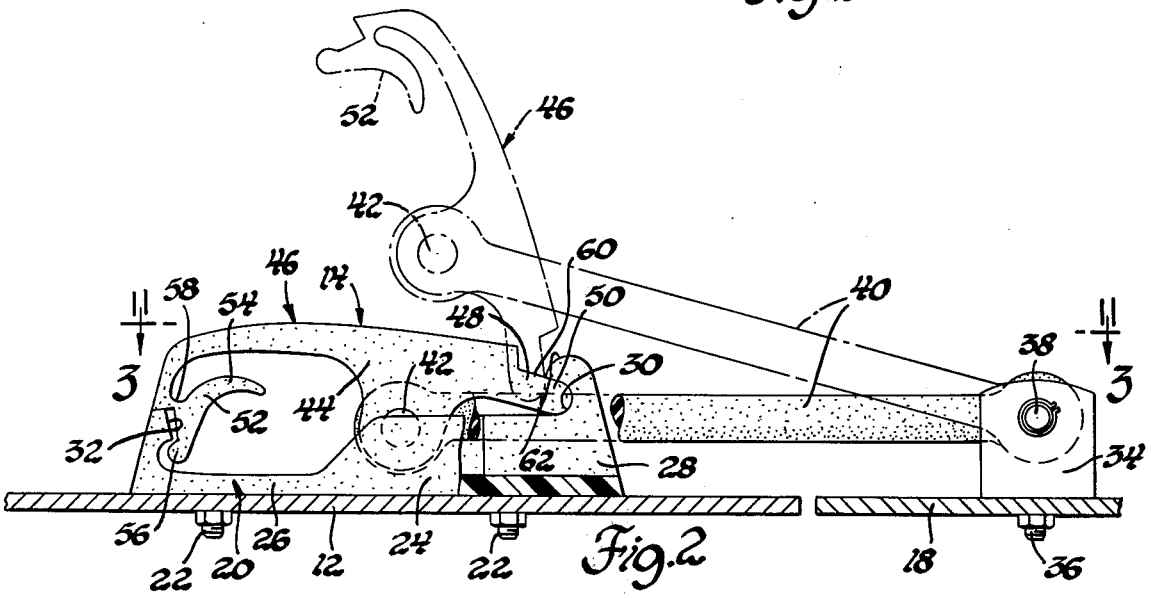
FIG. 2 is a partially broken away enlarged view of a portion of FIG. 1 showing the overcenter type latch in full lines in latched position and in dash lines in unlatched position.
Figure 3:
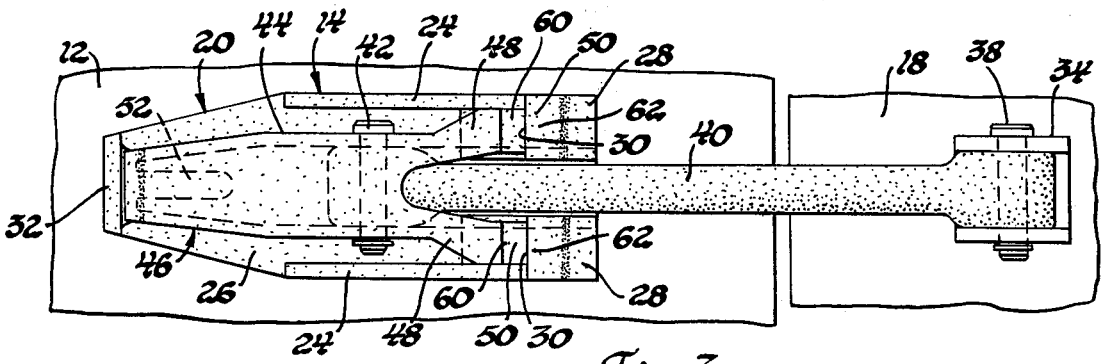
FIG. 3 is a view taken generally along the plane indicated by line 3—3 of FIG. 2.

Referring now particularly to FIGS. 2 and 3 of the drawings, the latch 14 generally includes a handle retainer 20 which is of molded plastic and is bolted at 22 to the hood 12. The retainer 20 includes a pair of side walls 24 which extend upwardly from the base wall 26 of the retainer. Although not shown, it will be understood the base wall includes suitable countersunk openings for the bolts 22. At one end, the retainer 20 includes laterally spaced upstanding integral lugs 28, each having a longitudinally open recess 30, the outer side of which is closed by a wall 24 and the inner side of which is open to the space between the lugs. At the other end thereof, the retainer 20 includes an integral abutment or striker 32.

A clevis 34 is bolted at 36 to the pillar structure 18 and the apertured ears of the clevis are pivoted at 38 to one end of an elastomeric link 40. This end of the link is enlarged and apertured to receive the pivot 38. Preferably the link 40 is of rubber or other suitable elastomeric material.

The other enlarged apertured end of the link 40 is pivoted at 42 between spaced apertured side walls 44 of an operating handle 46 of molded plastic. One end of handle 46 is bifurcated and includes laterally spaced legs or extensions 48 which terminate in rounded abutments 50 which are respectively received within the recesses 30 of the retainer 20 for pivoting of the handle to the retainer for movement between an overcenter latched position shown in full lines in FIG. 2 and an unlatched position shown in dash lines therein. The other end of the handle 46 includes a manually operable latch element 52 having a finger engageable portion 54, a latching portion 56 and an integral web 58 connecting the latch element to the handle 46.

When the handle member 46 is in overcenter latched position, the abutments 50 are received within their respective recesses 30, the pivot 42 is overcenter with respect to the pivot 38 and the engagement of the abutments with the recesses, and the link 40 is tensed to retain the pivot 42 overcenter. The latching portion 56 of latch element 52 is located underneath the striker 32 to block movement of the handle to unlatched position. Since the latch element 52 is located between the handle 46 and the retainer 26 it can only be released by the operator inserting his fingers into the space between the handle and the retainer and grasping the handle.

When it is desired to release the latch, the operator inserts one or more fingers between the handle 46 and the retainer 26 and engages the portion 54 of the latch element 52 as he grasps the handle. This moves the latch element 52 counterclockwise relative to handle 46 about web 58 to unblock the portion 56 from the striker 32 as the operator moves the handle to its unlatched position shown in dash lines in FIG. 2. The substantially simultaneous movement of the latch element and handle are easily effected by the operator.

When the handle 46 is in the unlatched position, the handle and link move with the hood to open position. When it is desired to again latch the hood 12 to the pillar structure 18, the hood is first moved to closed position and then the operator manually grasps the handle 46 and tenses the link 40 to locate the handle in its unlatched position as shown in FIG. 2 with the upper surfaces 60 of the legs 48 engaged against the arcuate surfaces 62 of lugs 28 to thereby provide a fulcrum for movement of the handle 46 from its unlatched position to its latched position. As the handle moves to its overcenter latched position, the portion 56 of the latch element 52 engages and cams over and underneath the striker 32 as the latch element 52 pivots with respect to the handle 46 about web 58. The movement of the portion 56 into blocked position with respect to the striker is automatic and requires no manual movement of the latch element.

Thus this invention provides an improved overcenter type latch.

I claim:

1. An overcenter type latch for securing a pair of relatively movable members to each other comprising, in combination, an elongated retainer for securement to one member and including a pair of laterally spaced recesses adjacent one end portion thereof and an upstanding leg adjacent the other end thereof having a shoulder providing a striker, an elongated handle including a pair of laterally spaced abutments adjacent one end thereof engageable within the recesses of the retainer to pivot the handle to the retainer for movement between an unlatched position and an overcenter latched position wherein the other end of the handle engages the leg to locate the handle in spaced relationship to the retainer, elastomeric link means for pivotal securement to the other member and to the handle, the link means being tensed and extending through the space between the recesses and the abutments when the handle is in overcenter latched position, the pivot of the link means to the handle being overcenter with respect to the pivot of the link means to the other member and the engagement of the abutments with the recesses, and a manually operable latch element pivoted to the handle adjacent the other end thereof and located in the space between the handle and retainer, said latch element including a latch shoulder juxtaposed to the striker shoulder when the handle is in overcenter latched position to block movement of the handle to unlatched position, and a finger engageable portion operable by the operator inserting his fingers in the space between the handle and retainer and manually grasping the finger portion and handle to pivot the latch element relative to the handle and move the latch shoulder out of juxtaposition to the striker shoulder concurrently with movement of the handle to unlatched position.

2. An overcenter type latch for securing a pair of relatively movable members to each other comprising, in combination, an elongated retainer for securement to one member and including a pair of laterally spaced recesses adjacent one end portion thereof and an upstanding leg adjacent the other end thereof having a shoulder providing a striker, an elongated handle of plastic material including a pair of laterally spaced abutments adjacent one end thereof engageable within the recesses of the retainer to pivot the handle to the retainer for movement between an unlatched position and an overcenter latched position wherein the other end of the handle engages the leg to locate the handle in spaced relationship to the retainer, elastomeric link means for pivotal securement to the other member and to the handle, the link means being tensed and extending through the space between the recesses and the abutments when the handle is in overcenter latched position, the pivot of the link means to the handle being overcenter with respect to the pivot of the link means to the other member and the engagement of the abutments with the recesses, and a manually operable latch element integrally pivoted to the handle by a flexible web adjacent the other end thereof and located in the space between the handle and retainer, said latch element including a latch shoulder juxtaposed to the striker shoulder when the handle is in overcenter latched position to block movement of the handle to unlatched position, and a finger engageable portion operable by the operator inserting his fingers in the space between the handle and retainer and manually grasping the finger portion and handle to pivot the latch element relative to the handle and move the latch shoulder out of juxtaposition to the striker shoulder concurrently with movement of the handle to unlatched position, movement of the handle to overcenter latched position engaging the latch shoulder with the striker shoulder to pivot the latch element relative to the handle and permit the latch shoulder to move past and in juxtaposition to the striker shoulder.

3. An overcenter type latch for securing a pair of relatively movable members to each other comprising, in combination, a molded plastic retainer for securement to one member and including a pair of laterally spaced integral lugs adjacent one end portion thereof, each including an arcuate recess and an arcuate lead in cam surface, an upstanding integral leg adjacent the other end of the retainer having a shoulder providing a striker, an elongated molded plastic handle including a pair of laterally spaced abutments adjacent one end thereof slidably movable along a respective lead in cam surface and into engagement within a respective recess of the retainer to pivot the handle to the retainer for movement between an unlatched position and an overcenter latched position wherein the other end of the handle engages the leg to locate the handle in spaced relationship to the retainer, an elastomeric link for pivotal securement to the other member and to the handle, the link being tensed and extending through the space between the retainer lugs and handle abutments when the handle is in overcenter latched position, the pivot of the link to the handle being overcenter with respect to the pivot of the link to the other member and the engagement of the abutments with the recesses, and a manually operable latch element integrally pivoted by a flexible web to the handle adjacent the other end thereof and located in the space between the handle and retainer, said latch element including a latch shoulder juxtaposed to the striker shoulder when the handle is in overcenter latched position to block movement of the handle to unlatched position, and a finger engageable portion operable by the operator inserting his fingers in the space between the handle and retainer and manually grasping the finger portion and handle to pivot the latch element relative to the handle and move the latch shoulder out of juxtaposition to the striker shoulder concurrently with movement of the handle to unlatched position, the latch shoulder being engageable with the striker shoulder to pivot the latch element relative to the handle and permit the latch shoulder to move past and in juxtaposition to the striker shoulder upon movement of the handle to the overcenter latched position.

* * * * *